US007139518B2

(12) United States Patent
Masubuchi

(10) Patent No.: US 7,139,518 B2
(45) Date of Patent: Nov. 21, 2006

(54) IMAGE FORMING APPARATUS AND IMAGE FORMING METHOD WITH DETECTING A POSITIONAL DEVIATION IN A MAIN SCANNING DIRECTION

(75) Inventor: Fumihito Masubuchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 4 days.

(21) Appl. No.: 10/942,914

(22) Filed: Sep. 17, 2004

(65) Prior Publication Data

US 2005/0063740 A1 Mar. 24, 2005

(30) Foreign Application Priority Data

Sep. 19, 2003 (JP) ..... 2003-328945

(51) Int. Cl.
*G03G 15/01* (2006.01)

(52) U.S. Cl. ..... 399/301; 399/159; 399/299; 399/302

(58) Field of Classification Search ..... 399/299, 399/301, 302, 298, 394, 395, 159, 167
See application file for complete search history.

(56) References Cited

U.S. PATENT DOCUMENTS

| | | | | |
|---|---|---|---|---|
| 4,752,804 | A * | 6/1988 | Ohno | 399/300 |
| 5,158,924 | A | 10/1992 | Konagaya et al. | |
| 5,158,926 | A | 10/1992 | Hotta et al. | |
| 5,283,220 | A | 2/1994 | Kawaguchi et al. | |
| 5,310,718 | A | 5/1994 | Amano et al. | |
| 5,321,239 | A | 6/1994 | Masubuchi et al. | |
| 5,371,522 | A | 12/1994 | Miyawaki et al. | |
| 5,379,058 | A | 1/1995 | Obu et al. | |
| 5,448,065 | A | 9/1995 | Masubuchi et al. | |
| 5,489,494 | A | 2/1996 | Hotta et al. | |
| 5,538,822 | A | 7/1996 | Hotta et al. | |
| 5,556,827 | A | 9/1996 | Nogiwa et al. | |
| 5,583,554 | A | 12/1996 | Masubuchi et al. | |
| 5,612,278 | A | 3/1997 | Masubuchi et al. | |
| 5,616,262 | A | 4/1997 | Itoda et al. | |
| 5,625,524 | A | 4/1997 | Konagaya et al. | |
| 5,635,319 | A | 6/1997 | Hotta et al. | |
| 5,747,413 | A | 5/1998 | Amano et al. | |
| 5,762,998 | A | 6/1998 | Konagaya et al. | |
| 5,869,421 | A | 2/1999 | Kutami et al. | |
| 5,896,156 | A | 4/1999 | Suzuki et al. | |
| 5,896,159 | A | 4/1999 | Masubuchi et al. | |
| 5,946,019 | A | 8/1999 | Suzuki et al. | |
| 5,985,077 | A | 11/1999 | Konagaya et al. | |
| 6,060,425 | A | 5/2000 | Morohoshi et al. | |
| 6,343,853 | B1 | 2/2002 | Masubuchi et al. | |
| 6,507,713 | B1 * | 1/2003 | Koide | 399/51 |

(Continued)

FOREIGN PATENT DOCUMENTS

| | | |
|---|---|---|
| JP | 8-286135 | 11/1996 |

(Continued)

*Primary Examiner*—Sophia S. Chen
(74) *Attorney, Agent, or Firm*—Oblon, Spivak, McClelland, Maier & Neustadt, P.C.

(57) ABSTRACT

In an image forming apparatus that transfers images formed on plural photosensitive drums onto a belt in a superimposing manner to produce a multi-color image, a positional deviation in a main scanning direction, which is generated while transferring the images formed, is detected. An eccentricity phase of each of the photosensitive drums is calculated based on the positional deviation detected, and a rotational phase of the photosensitive drums is controlled based on the eccentricity phase calculated.

8 Claims, 9 Drawing Sheets

U.S. PATENT DOCUMENTS

| | | | | |
|---|---|---|---|---|
| 6,788,914 | B1 * | 9/2004 | Wasai | 399/301 |
| 6,876,821 | B1 * | 4/2005 | Ishii et al. | 399/49 |
| 2001/0046391 | A1 * | 11/2001 | Koide | 399/159 X |
| 2002/0136570 | A1 * | 9/2002 | Yamanaka et al. | 399/301 |
| 2003/0068180 | A1 * | 4/2003 | Kaji | 399/301 |
| 2003/0091368 | A1 * | 5/2003 | Yamamoto et al. | 399/116 |
| 2003/0180072 | A1 * | 9/2003 | Ohashi et al. | 399/167 |

FOREIGN PATENT DOCUMENTS

| | | | |
|---|---|---|---|
| JP | 9-146329 | | 6/1997 |
| JP | 11-249526 | * | 9/1999 |
| JP | 2001-228679 | | 8/2001 |
| JP | 2001-339972 | | 12/2001 |
| JP | 2002-372872 | | 12/2002 |
| JP | 2003-270892 | | 9/2003 |
| JP | 2004-101618 | A1 * | 4/2004 |

* cited by examiner

IMAGE FORMING APPARATUS AND IMAGE FORMING METHOD WITH DETECTING A POSITIONAL DEVIATION IN A MAIN SCANNING DIRECTION

CROSS-REFERENCE TO RELATED APPLICATIONS

The present document incorporates by reference the entire contents of Japanese priority document, 2003-328945 filed in Japan on Sep. 19, 2003.

BACKGROUND OF THE INVENTION

1) Field of the Invention

The present invention relates to compensating for a color shift that occurs at a time of image transfer, in an image forming apparatus, such as a plain paper reproducing machine, a plain paper facsimile machine, a page printer, and the like, that produces multi-color images.

2) Description of the Related Art

In an image forming apparatus of a so-called tandem type, a multi-color image is produced by transferring images formed on a plurality of photosensitive drums in a superimposing manner. In such image forming apparatus, dynamic transfer color shift is caused due to factors such as angular speed fluctuation of a photosensitive drum occurring at a gear or a joint, speed fluctuation of a transfer belt, eccentricity of the photosensitive drum, and speed unevenness between belt positions occurring due to stretching of the transfer belt, which cause positional deviations among transfer patterns corresponding to the respective photosensitive drums, and these positional deviations finally appear as a color shift.

Of the above causes, the eccentricity of the photosensitive drum generates a positional deviation corresponding to one rotation of the drum. However, Japanese Patent Application Laid-Open No. H9-146329 discloses a countermeasure where phases of eccentricities of a plurality of photosensitive drums are properly adjusted so that, even if positional deviation occurs in respective photosensitive drums, color shift among the photosensitive drums is prevented from occurring.

As a method for detecting eccentricity of a photosensitive drum, Japanese Patent Application Laid-Open No. 2001-339972 discloses a technology that uses a displacement gauge of a contact type and one of a non-contact type. However, the gauge of the contact type is not reliable, and the gauge of the non-contact type (an optical system) has a complicated configuration.

Japanese Patent Application Laid-Open No. H9-146329 discloses that when eccentricities of respective photosensitive drums are adjusted, a method of detecting the eccentricities is important. Patterns for detecting positional deviation, each being constituted of a toner image, that are formed on a transfer belt (an endless belt), are sequentially sampled by optical sensors, to detect positional deviation data in a sub-scanning direction, and information about the eccentricities.

However, since the positional deviation data in the sub-scanning direction obtained by sampling basically includes a plurality of positional deviations caused by the transfer color shifts, it contains rather complicated waveforms. Therefore, it is very difficult to separate or extract information about a cyclic positional deviation corresponding to one rotation of the photosensitive drum from the positional deviation information, and the separated information is not very accurate.

The positional deviation corresponding to a cycle of one rotation of the photosensitive drum appears as synthesis of a positional deviation due to eccentricity of the photosensitive drum itself, and a positional deviation due to an angular speed fluctuation of a shaft of the photosensitive drum. Moreover, a phase thereof is different from a phase due to the eccentricity of the photosensitive drum itself. Therefore, even if the phase of the cyclic positional deviation corresponding to one rotation of the drum is detected, the phase of the drum eccentricity cannot be obtained.

The eccentricity of the photosensitive drum causes a positional deviation in a sub-scanning direction and a positional deviation in a main scanning direction, and it is preferable to reduce both the deviations. The details of a generating mechanism of the deviations is explained later, but the deviations occur due to fluctuation of the writing position due to the eccentricity of the photosensitive drum, because a writing beam is obliquely incident on a surface of the photoconductor.

Even if the phase of the positional deviation in the sub-scanning direction is not grasped, it is possible to correct the positional deviation in the sub-scanning direction by synthesizing the deviation with the positional deviation due to the angular speed fluctuation in the same cycle. However, the positional deviation in the main scanning direction cannot be corrected unless a phase thereof is grasped.

The main scanning direction herein is the same direction as image writing direction of writing an image to the photosensitive drum, and is parallel to a direction in which a rotational shaft of the photosensitive drum extends. The sub-scanning direction is perpendicular to the main scanning direction on an image plane, and corresponds to a conveying direction of a transfer belt. These definitions are applied in the following explanation.

SUMMARY OF THE INVENTION

It is an object of the present invention to at least solve the problems in the conventional technology.

An image forming apparatus according to an aspect of the present invention includes a plurality of photosensitive drums, on which images are formed and from which the images formed are transferred in a superimposing manner to produce a multi-color image; a deviation detecting unit that detects a positional deviation in a main scanning direction, which is generated while transferring the images formed, wherein an eccentricity phase of each of the photosensitive drums is calculated based on the positional deviation in the main scanning direction, and a rotational phase of the photosensitive drums is controlled based on the eccentricity phase calculated.

An image forming apparatus according to another aspect of the present invention includes a plurality of photosensitive drums having a scanning surface on which light beams are scanned to produce electrostatic latent images that are visualized with toners corresponding to color image information of respective the light beams, to obtain visualized images that are finally transferred on a sheet-like medium to obtain an image; and a deviation detecting unit that detects a positional deviation in a main scanning direction, which is generated while transferring the visualized images. A rotational phase of the photosensitive drums is controlled based on the positional deviation detected.

An image forming method according to still another aspect of the present invention includes detecting a positional deviation in a main scanning direction, which is generated while transferring images formed on photosensitive drums onto a writing medium; calculating an eccentricity phase of each of the photosensitive drums based on the positional deviation detected; and controlling a rotational phase of the photosensitive drums based on the eccentricity phase calculated.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus and an image forming method according to the present invention will be explained in detail with reference to the accompanying drawings.

A positional deviation in a sub-scanning direction is merged in a complicated positional deviation waveform, as described above. On the other hand, as compared with the positional deviation in the sub-scanning direction, a positional deviation in a main scanning direction has less causes of the positional deviation except for a writing position fluctuation due to eccentricity of a photosensitive drum. At least positional deviation corresponding to a drum rotation cycle is caused by only eccentricity of the photosensitive drum.

Accordingly, it is easier to detect the positional deviation in the main scanning direction to calculate eccentricity of the photosensitive drum therefrom, which can be performed with a higher precision than the positional deviation in the sub-scanning direction. A mechanism of generation of a transfer positional deviation due to eccentricity of a photosensitive drum and a countermeasure thereto will be explained below.

Figure 1:
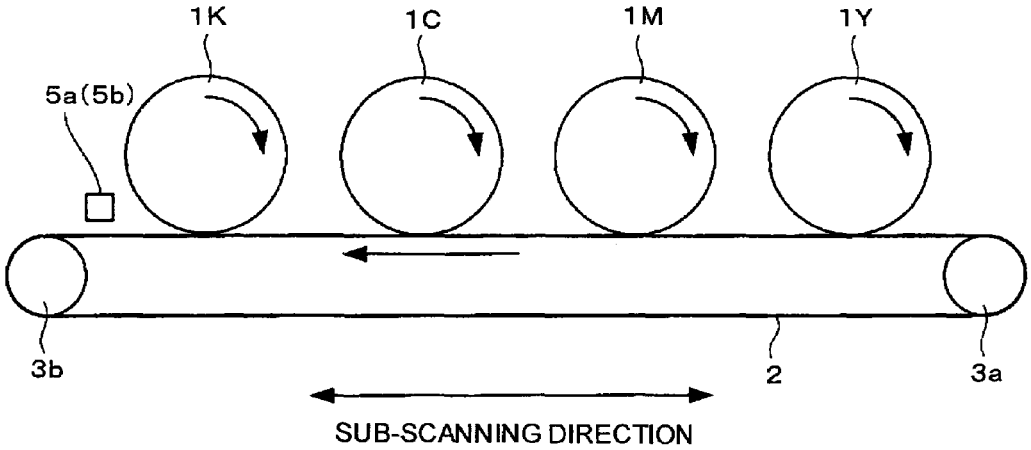
FIG. 1 is a front view of photosensitive drums that are a main portion of a multi-color image forming apparatus.
Figure 2:
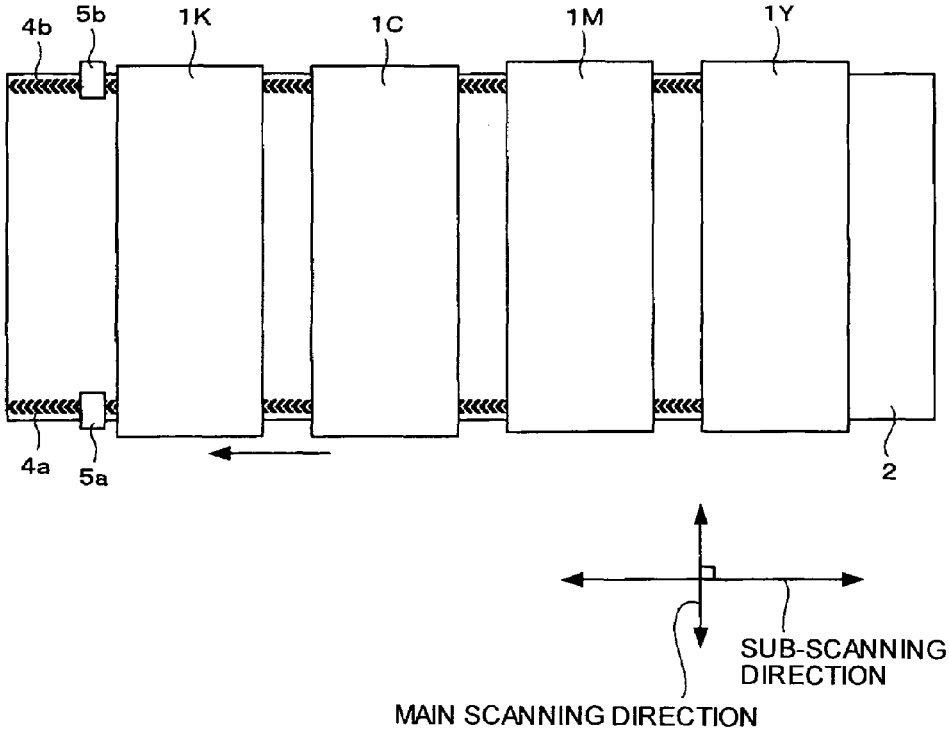
FIG. 2 is a plan view of the photosensitive drums.

FIGS. 1 and 2 are views of photosensitive drums that are a main portion of a multi-color image forming apparatus, where a multi-color image is formed by transferring images formed on a plurality of photosensitive drums 1Y (Yellow), 1M (Magenta), 1C (Cyan), and 1K (black) directly on a belt 2 wound between rollers 3*a* and 3*b*, or transferring the images on a sheet-like medium conveyed on the belt 2 in a superimposing manner.

FIG. 1 is a front view of the main portion, as seen from an axial direction of the photoconductors, where an upper face of the belt 2 moves in left and right directions. The left and right directions correspond to a sub-scanning direction on an upper face of the belt. FIG. 2 is a plan view of the main portion, viewing the configuration shown in FIG. 1 from the top, where left and right directions are the sub-scanning direction. A direction perpendicular to the sub-scanning direction, namely, a rotational shaft direction of the photosensitive drum is the main scanning direction.

Each photosensitive drum is manufactured by a mechanical manufacturing process, but it is impossible to eliminate eccentricity that occurs when the photosensitive drum is rotated about a rotational shaft. Main influence of the eccentricity of the photosensitive drum on a transfer positional deviation occurs due to fluctuation of a writing position.

Figure 3:
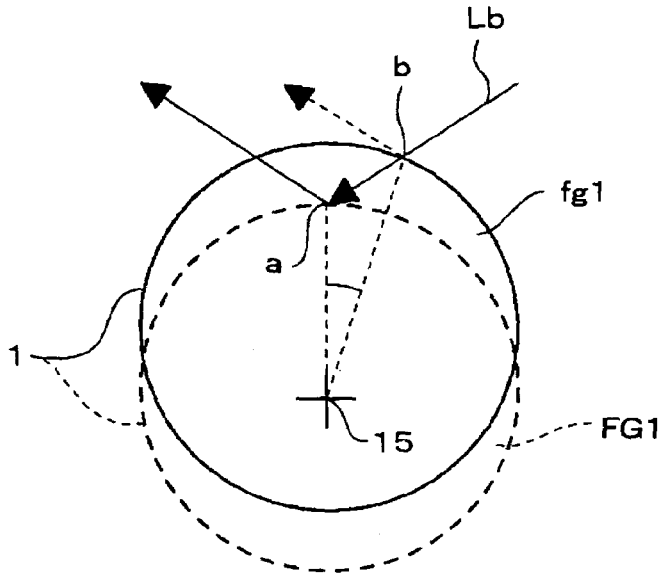
FIG. 3 is an explanatory diagram of a displacement of a writing position corresponding to an amount of eccentricity of the photosensitive drum.

Any one of the respective photosensitive drums shown in FIGS. 1 and 2 is selected, and it is denoted by reference numeral 1 as a representative one in FIG. 3. In FIG. 3, an original position of the photosensitive drum 1 is represented with a broken line circle and it is designated with a reference sign FG1. On the other hand, a position of the photosensitive drum 1 displaced by an eccentric amount according to rotation of the photosensitive drum 1 is shown with a solid line circle and it is designated with a reference sign fg1.

In a so-called electrophotographic apparatus using laser beams or the like, which is constituted as a general multi-color image forming apparatus, a writing light beam is obliquely incident on a surface of the photosensitive drum in a sub-scanning direction to reduce influence of multiple reflections on an interface of the photosensitive drum constituted on a surface of the photosensitive drum.

In FIG. 3, it is set such that a writing light beam Lb is incident just above a drum rotational shaft 15 from an obliquely right and upper direction at the original drum position FG1. When a height of a drum surface is varied from an original position shown with a broken line to a displaced position shown with a solid line by eccentricity, a writing light beam irradiating position on a surface of the photosensitive drum is deviated from a writing position "a" to a position "b". The amount of deviation can be obtained by substituting the surface of the photosensitive drum to a flat plane, as shown in FIG. 4.

Figure 4:
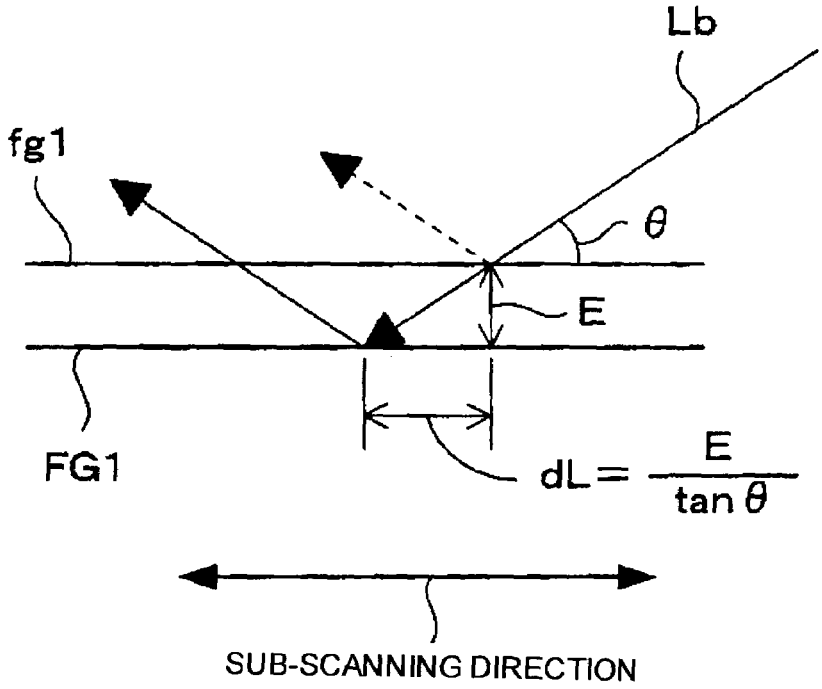
FIG. 4 is a schematic of a surface of the photosensitive drum redrawn in a plane for explaining the displacement of the writing position.

In FIG. 4, when an incident angle of a writing light beam Lb to a surface of a photosensitive drum (a sub-scanning direction) is represented as θ and an amount of eccentricity is represented as E, a deviation amount of a writing position (amplitude) dL is expressed as follows:

$$dL=E/\tan\theta \quad (1).$$

A cycle of the writing positional deviation becomes equal to a cycle of eccentricity, namely, a rotational cycle of the drum. The writing positional deviation constitutes a positional deviation on the belt 2 as it is. A similar writing positional deviation occurs in the main scanning direction. The main scanning direction corresponds to a drawing-penetrating direction (a direction of a rotational shaft of a photosensitive drum) in FIGS. 3 and 4.

The main scanning may be performed by swinging a laser beam about one point (a polygon mirror, a galvanomirror, or the like). Since the writing light beam Lb is incident on a surface of the photosensitive drum at a central portion in the main scanning direction vertically to the main scanning direction, a writing positional deviation does not occur. However, the writing light beam Lb becomes incident on the surface of the photosensitive drum obliquely to the main scanning direction according to movement of the writing light beam Lb toward both ends in the main scanning direction. Therefore, a writing positional deviation occurs at both end portions in the main scanning direction due to eccentricity. At this time, when it is assumed that θ in the equation (1) for a deviation amount of a writing position is an incident angle to the main scanning direction, the positional deviation of the writing position in the main scanning direction can be obtained.

The writing positional deviation in the main scanning direction includes two features that are not included in that in the sub-scanning direction.

First, positional fluctuations at both ends are positional fluctuation having the same fluctuation amount but directions opposed to each other. Therefore, a width of an image in the main scanning direction varies according to eccentricity.

Second, in the positional deviation in the sub-scanning direction, when fluctuation occurs in an angular speed of the photosensitive drum, the fluctuation appears as a positional deviation. In the positional deviation in the main scanning direction, however, the angular speed fluctuation does not influence the positional deviation. That is, a positional deviation of the rotational cycle of the drum on the belt in the main scanning direction includes only the writing positional deviation.

By utilizing these features, it is made easy to calculate eccentricity of the photosensitive drum from the positional deviation in the main scanning direction. Although a positional deviation due to fluctuation of a transfer position due to eccentricity of the photosensitive drum is also, present, since this positional deviation is much smaller in amount than that due to fluctuation of the writing position, its explanation will be omitted.

A method for detecting a writing positional deviation in a main scanning direction will be explained next.

There is a method for detecting a position of a pattern, meant for detecting positional deviation that is generated while the image formed on a photosensitive drum is transferred on a belt, by using a sensor serving as a detector for a positional deviation in a main scanning direction.

Figure 5A:
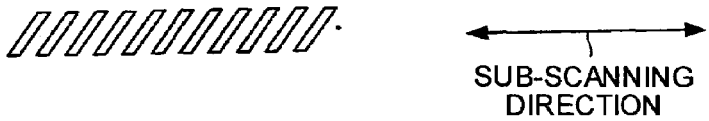
FIGS. 5A and 5B are examples of patterns used for detecting positional deviation.
Figure 5B:
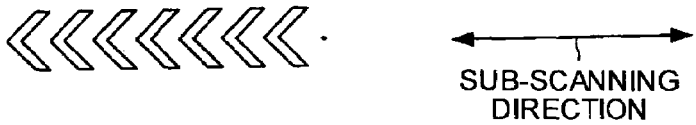

An embodiment of a shape of the pattern for positional deviation detection includes a pattern constituted of oblique lines angled to a sub-scanning direction continuously arranged in a sub-scanning direction with an equal interval pitch, as shown in FIG. 5A, and a pattern for positional deviation detection constituted of angle-shaped marks continuously arranged in a sub-scanning direction with an equal interval pitch, as shown in FIG. 5B.

In the embodiment shown in FIG. 2, the patterns 4 for positional deviation detection shown in FIG. 5B are shown on a surface of the belt 2 on both end portions thereof in the main scanning direction.

In the positional deviation in the main scanning direction, the writing positional deviation on the photosensitive drum can be separated more easily than that in the positional deviation in the sub-scanning direction. However, it is required to discriminate the writing positional deviation from a positional deviation due to another cause.

The cause of the positional deviation in the main scanning direction includes the "swinging" of the belt 2 in addition to the eccentricity of the photosensitive drum. The "swinging" means a phenomenon that a belt swings in a main scanning direction, and a cycle of the swing is frequently equal to a cycle of a drive roller of rollers around which the belt is wound. Accordingly, in particular, when a rotational cycle of the drive roller is close to a rotational cycle of the photosensitive drum, a positional deviation waveform becomes complicated due to mutual interference, which may obstruct separation of the writing positional deviation.

As the countermeasure to this problem, there are two solutions.

One solution is such that a rotational cycle of a drive roller that drives the belt is set to N times or 1/N times (N is an integer, N>=2) a rotational cycle of the photosensitive drum, so that interference is minimized and causes of the positional deviation are discriminated from one another periodically.

The other solution is such that patterns for positional deviation detection are provided on both end portions of the transfer belt in the main scanning direction, a change in width of an image in the main scanning direction, which is one of the features of the writing positional deviation in the main scanning direction as described above, is detected by comparing positional deviations in the main scanning direction detected regarding the both patterns with each other, so that only a writing positional deviation in the main scanning direction is separated.

Figure 6:
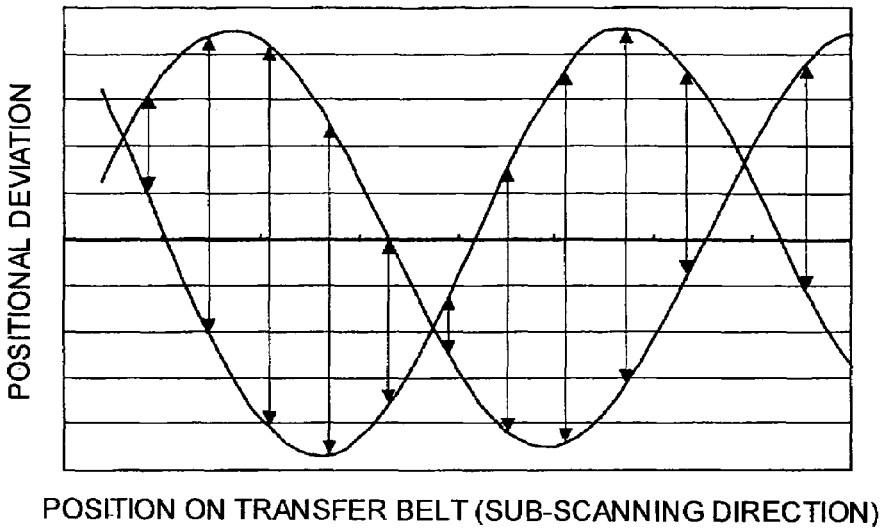
FIG. 6 is a graph of writing positional deviation of two photosensitive drums having the same eccentricity and the same amplitude, but having phases shifted from each other.

For example, it is considered that such positional deviations are generated at any two photosensitive drums arranged in left and right directions. It is assumed herein that both photosensitive drums have the same eccentricity amount thereof. As shown in FIG. 6, curves with the same amplitude of two positional deviations are generated.

Because a difference between two curves is recognized as a color shift, as shown with arrows in FIG. 6, the color shift is cancelled by adjusting phases of the two curves (adjusting a phase difference to 0). On the contrary, when a phase difference between two curves is just 180 degrees, amplitude of a color shift becomes two times the positional deviation. The positional deviation is also cancelled by adjusting the phases of the two curves and further performing such control that a speed fluctuation of the belt 2 has the same cycle and phase as the positional deviation of the photosensitive drum.

Because relationship between phases of writing positional deviations in the main scanning direction and the sub-scanning direction are the same in all the photosensitive drums, when a phase difference of a writing positional deviation curve in the sub-scanning direction between photosensitive drums becomes 0, a phase difference of a writing positional deviation curve in the main scanning direction becomes 0, and the color shift between both the photosensitive drums becomes 0.

In order to set a phase difference between two curves to 0, eccentricity phases of respective photosensitive drums may be adjusted according to a distance between shafts of the photosensitive drums. More specifically, the zero phase difference can be achieved by causing an eccentricity phase of one of photosensitive drums adjacent to each other in a sub-scanning direction that is positioned on an upstream side regarding the transfer belt 2 to precede the other photosensitive drum positioned on a downstream side in a rotational direction thereof by a value (radian is the unit) obtained by dividing a distance between shafts of the photosensitive drums by a radius of the photosensitive drum.

Figure 7:
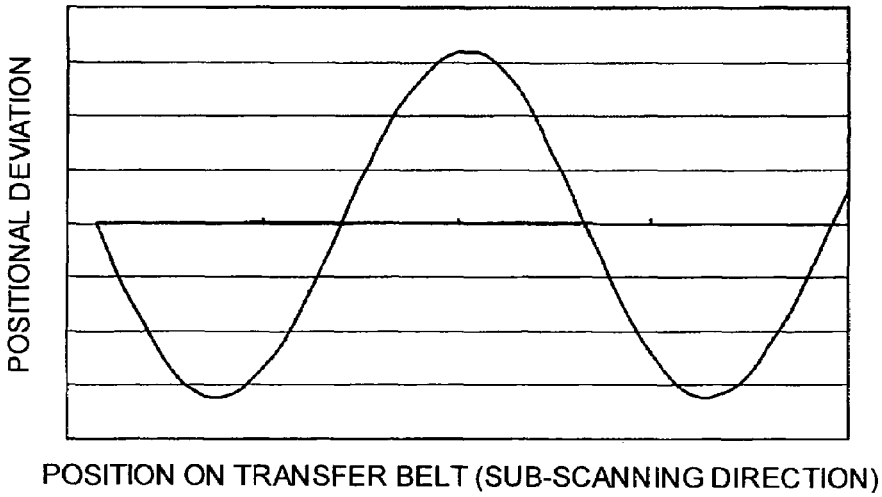
FIG. 7 is a graph of the writing positional deviation, assuming that the eccentricity amount in one of the two photosensitive drums in FIG. 6 is zero.

Actual eccentricity amounts of photosensitive drums are not constant and they are influenced by variations in manufacture. For example, when it is assumed that an eccentricity amount of either one photosensitive drum of two photosensitive drums in FIG. 6 is 0, since a transfer positional deviation does not occur regarding the one photosensitive drum, one of the two curves shown in. FIG. 6 disappears, which results in a graph such as that shown in FIG. 7. Obviously, even if eccentricity phases of the photosensitive drums are changed in any manner, the two curves are not superimposed with each other and the color shift is not eliminated. Accordingly, by adjusting eccentricity phases of the photosensitive drums such that a phase difference in positional deviation becomes 0, the color shift can be minimized but it cannot be totally eliminated.

Embodiments of sensor arrangement are explained next.

In the multi-color image forming apparatus of a tandem type shown in FIGS. 1 and 2, it is assumed that diameters of respective photosensitive drums 1Y to 1K are 100 millimeters (mm), diameters of the rollers 3*a* and 3*b* are 50 mm, and that the roller 3*b* is a drive roller.

As shown in FIG. 2, patterns 4*a* and 4*b* for positional deviation detection constituted of a toner image are respectively formed on the belt 2 at both end portions thereof in a sub-scanning direction of the belt 2 for each one line and they are sequentially sampled by optical sensors 5*a* and 5*b* provided on a downstream position of the photosensitive drum 1K. The optical sensors 5*a* and 5*b* are charge coupled device (CCD) line sensors and their lines extend in parallel with a main scanning direction. Since the positional deviation detecting pattern 4 has a relationship where each line constituting the pattern crosses both in the main scanning direction and the sub-scanning direction, positional deviations in both the main scanning direction and the sub-scanning direction can be detected by the sensors 5*a* and 5*b*. Accordingly, the sensors 5*a* and 5*b* serve as positional deviation detectors for a main scanning direction and they also serve as positional deviation detectors for a sub-scanning direction. A sensor 5*c* described later also serves a similar purpose.

Figure 8:
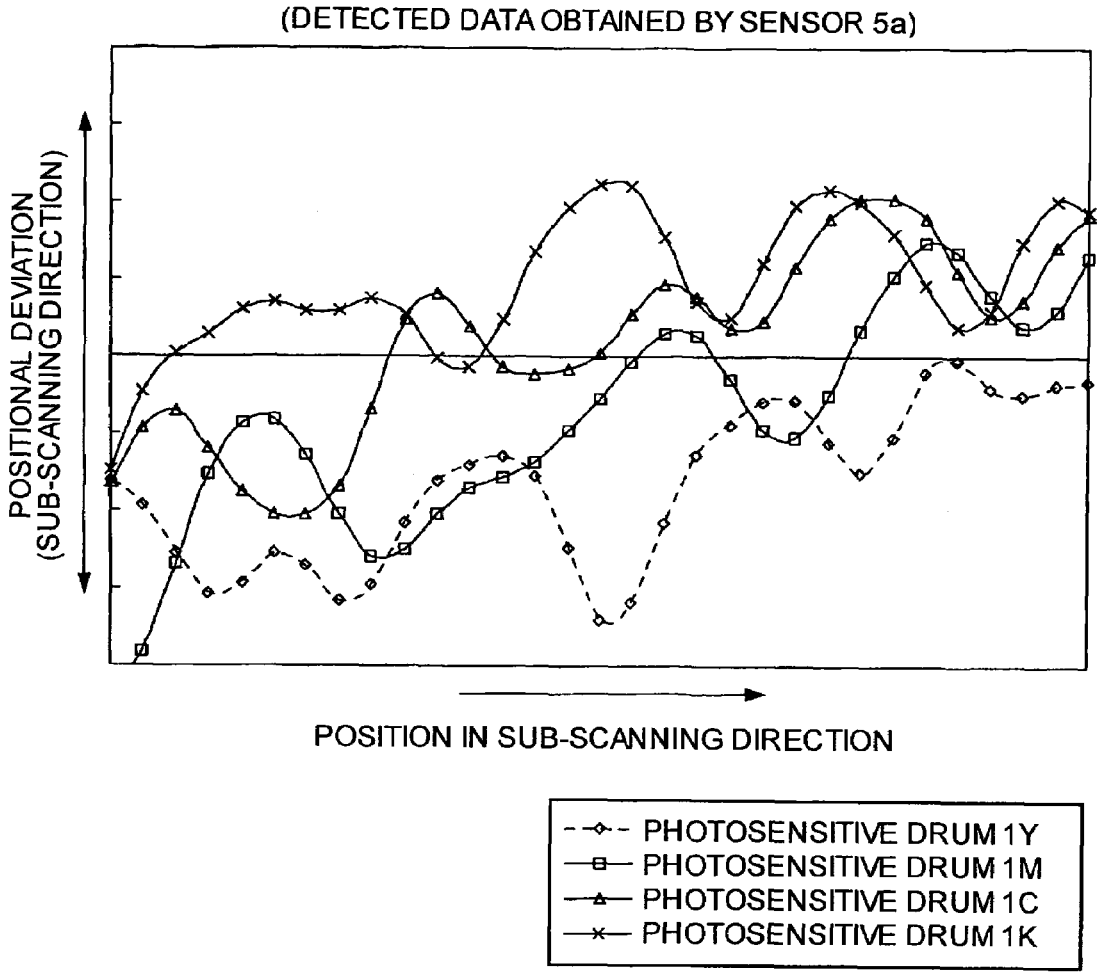
FIG. 8 is a graph of positional deviations in a sub-scanning direction due to eccentricities of four photosensitive drums, detected on a belt.

In the multi-color image forming apparatus of a tandem type configured as shown in FIGS. 1 and 2, sampling data for positional deviation detecting pattern obtained when such a drive system is employed that respective photosensitive drums 1Y to 1K are applied with pulse motors as drive sources and they are independently driven through one step reduction using a gear, is shown in FIG. 8. These patterns can be detected by the sensors 5*a* and 5*b*.

The horizontal axis direction in FIG. 8 is a position on the belt in the sub-scanning direction, and the vertical axis direction is a positional deviation amount in the sub-scanning direction. In FIG. 8, four kinds of waveforms are shown, and the respective waveforms correspond to the respective positional deviations of the four photosensitive drums 1Y to 1K. However, since various positional deviation factors such as eccentricity of each photosensitive drum, vibration of the drive source, and speed unevenness of the belt is included in the sub-scanning direction, waveforms obtained become complicated. That is, it is found from FIG. 8 that a cyclic pattern is present, but there is also a relatively high frequency positional deviation superimposed. Therefore, it is difficult to grasp the phase and the amplitude of a positional deviation of a cycle of the photosensitive drum from the contents in FIG. 8.

Figure 9:
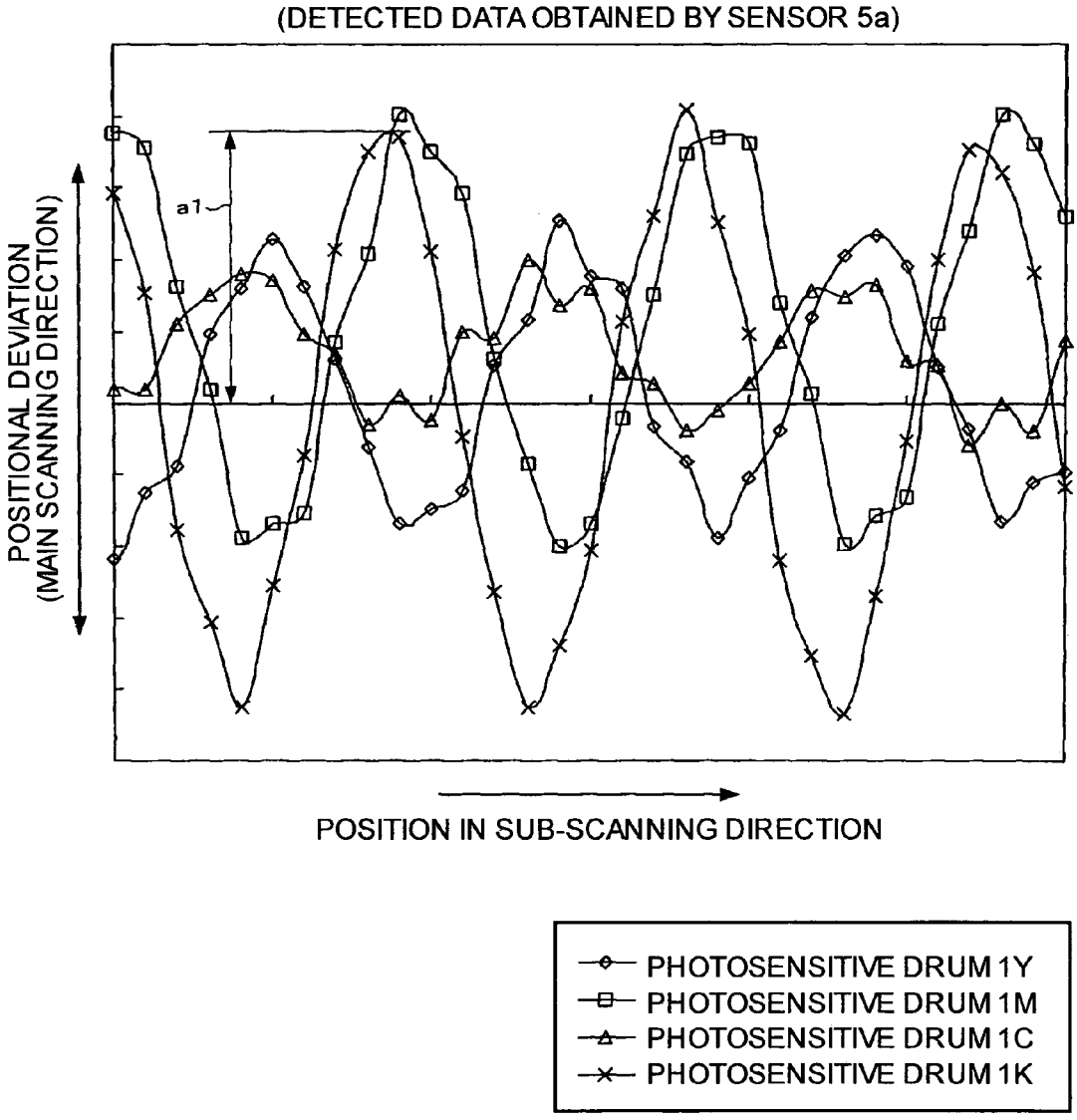
FIG. 9 is a graph of positional deviations in a main scanning direction due to eccentricities of four photosensitive drums detected on one end of a belt in a sub-scanning direction.
Figure 10:
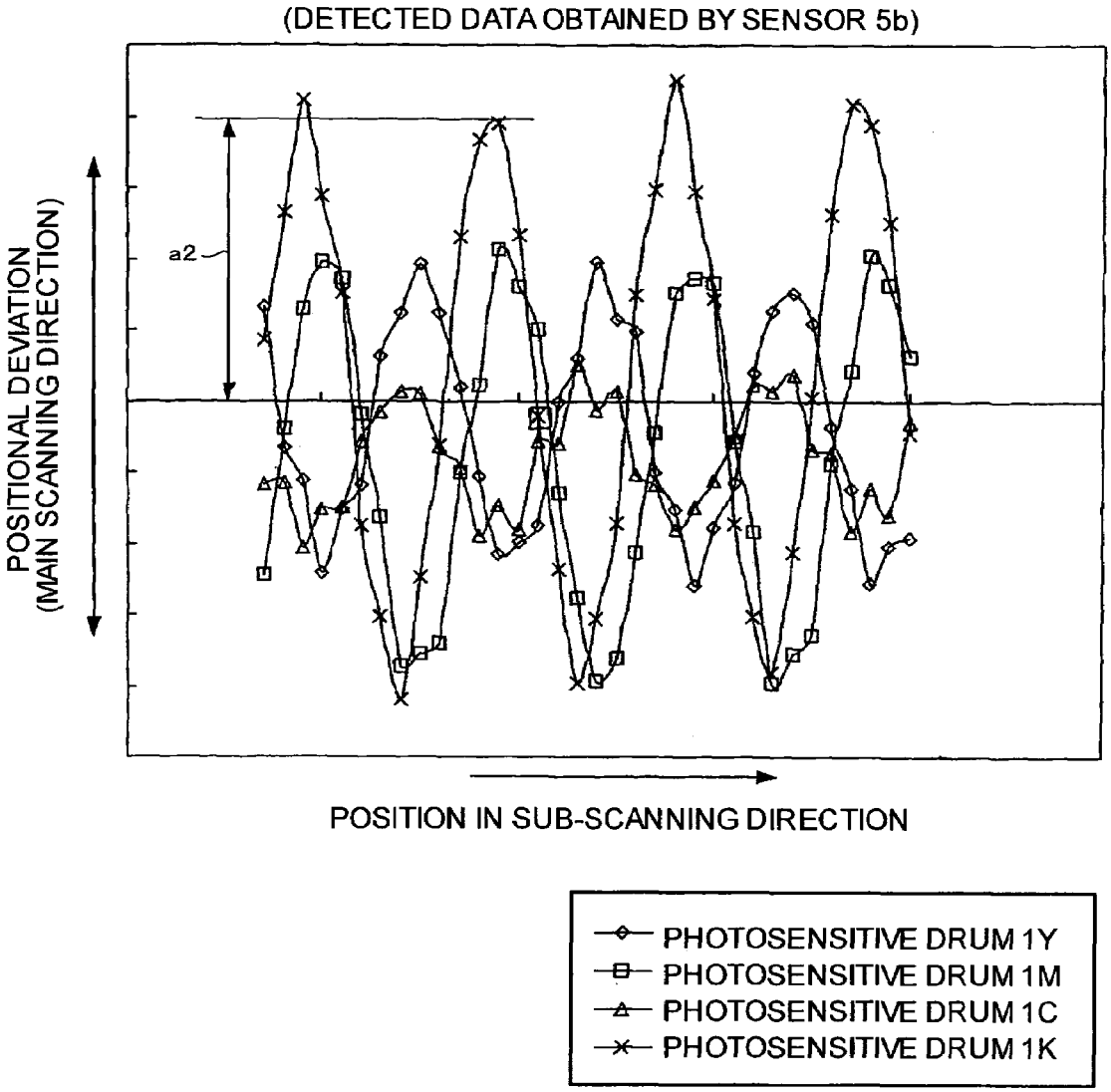
FIG. 10 is a graph of positional deviations in a main scanning direction due to eccentricities of four photosensitive drums detected on the other end of the belt in the sub-scanning direction.

On the other hand, FIGS. 9 and 10 are graphs of sampling data of positional deviations in a main scanning direction obtained by detecting positional deviation detection patterns at one end portion and the other end portion of the belt 2 in the main scanning direction by the sensors 5*a* and 5*b*, respectively. Since the samplings are performed in the main scanning direction, influence of the speed fluctuation of the belt hardly appears. Therefore, the high frequency positional deviation is reduced as compared with the data shown in FIG. 8, and the waveforms can be grasped more easily.

However, data in the main scanning directions includes positional deviation fluctuation due to the "swinging" of the belt. By forming the patterns for positional deviation detection on both end portions on the belt in a widthwise direction thereof, respectively, to compare positional deviations in the main scanning direction detected from both the patterns for positional deviation detection with each other, the positional deviation in the main scanning direction due to eccentricity of the photosensitive drum and the "swinging" in the main scanning direction generated on the belt by the drive roller for the transfer belt can be discriminated from each other.

That is, as described later, since an amount of the "swinging" can easily be obtained by averaging the positional deviations in the main scanning direction detected at both the patterns for positional deviation detection, the "swinging" can be corrected based on the amount or value of the "swinging".

The factor of the "swinging" is removed so that the data representing the positional deviation in the main scanning direction due to the eccentricity of the photosensitive drum can be obtained. An operation for removing the factor of the "swinging" is conducted in the following manner. Regarding each piece of data shown in FIGS. 9 and 10, a difference in positional deviation amount in the main scanning direction (the vertical axis) at the same position. (at the same point of time) in the sub-scanning directions (the horizontal axis) on each figure is grasped for each photosensitive drum so that the positional deviation fluctuation due to the "swinging" of the belt is eliminated and data about the eccentricity of the photosensitive drum can be obtained.

In an embodiment, regarding the waveform of the photosensitive drum 1K shown in FIG. 9, a positional deviation amount at any position (any time) in the main scanning direction is represented as a1, while regarding the photosensitive drum 1K shown in FIG. 10, a positional deviation amount at the same position (the same point of time) in the main scanning direction is represented as a2. A difference

Figure 11:
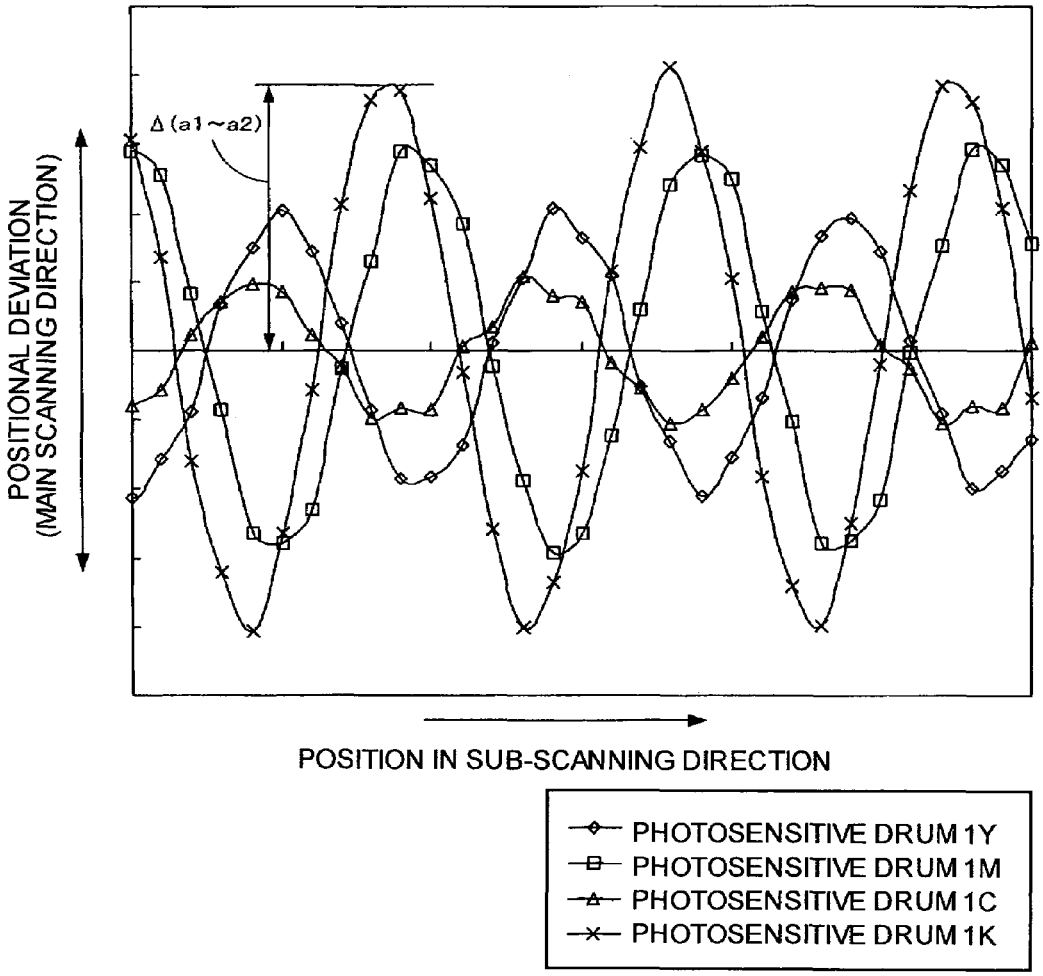
FIG. 11 is a graph of positional deviations in a main scanning direction due to eccentricities of four photosensitive drums where influence due to "swinging" of a belt is excluded.

[Δ(a1−a2)] between the positional deviation amount a1 and the positional deviation amount a2 is obtained and values obtained by the same operations are continuously plotted so that waveforms shown in FIG. 11 can be obtained.

In the above embodiment, the difference is calculated by using the values positioned above the center of the waveform as the positional deviation amount. However, when the difference is calculated on the amplitude, a difference between positional deviations in the main scanning direction obtained at both the patterns for positional deviation detection formed at both the end portions of the belt in the main scanning direction is divided by 2 to obtain a positional deviation in the main scanning direction generated by writing on the photosensitive drum, and the positional deviations in the main scanning direction detected at both the patterns for positional deviation detection are averaged so that the "swinging" can be obtained easily.

By removing the influence of the "swinging" of the belt obtained according to the above operation, a graph as shown in FIG. 11 where the positional deviation forms a generally complete sine wave shape can be obtained.

The amplitude and the phase of each curve shown in FIG. 11 correspond to the eccentricity phase and the amplitude of each photosensitive drum in a manner of 1:1. Therefore, since a processing for adjusting a phase difference between eccentricities of photosensitive drums to 0 is performed based on the data shown in FIG. 11, such a processing may be performed that a distance between peaks of adjacent photosensitive drums is measured from the curves, and the phase of the photosensitive drum is changed by a value obtained by dividing the measured distance by a radius of the photosensitive drum .

For example, regarding two adjacent photosensitive drums on the sub-scanning direction, a distance between the positions of the photosensitive drums where the positional deviation amount becomes the maximum is measured, and the phase(s) of the photosensitive drum(s) is shifted by a value obtained by dividing the distance by the radius of the photosensitive drum, so that the phases of the photosensitive drums are made coincident with each other. Specifically, a phase of the drive pulse of the drive pulse motor of one photosensitive drum to be made coincident with the other photosensitive drum is shifted. In this manner, the rotational phase of the photosensitive drum is controlled. Thereby, the same position on the belt 2 is made coincident with the eccentricity peak position on each photosensitive drum so that the positional deviation in the sub-scanning direction due to the eccentricity of the photosensitive drum is eliminated.

Since the sensors 5*a* and 5*b* serving as positional deviation detectors for a main scanning direction also serve as detectors for speed fluctuation of a belt or units that correct "swinging", existing sensors can be utilized. Therefore, it is unnecessary to add dedicated sensors, which allows a simple configuration.

In the data shown in FIGS. 9 and 10, the difference between the positional deviations in the main scanning direction detected at both the patterns for positional deviation detection is divided by 2 so that the positional deviation in the main scanning direction generated by writing on the photosensitive drum can be obtained, and the positional deviations in the main scanning direction detected at both the patterns for positional deviation detection are averaged so that the amount of the "swinging" can easily be obtained. Therefore, the "swinging" can be corrected based on the amount of the "swinging".

Figure 12:
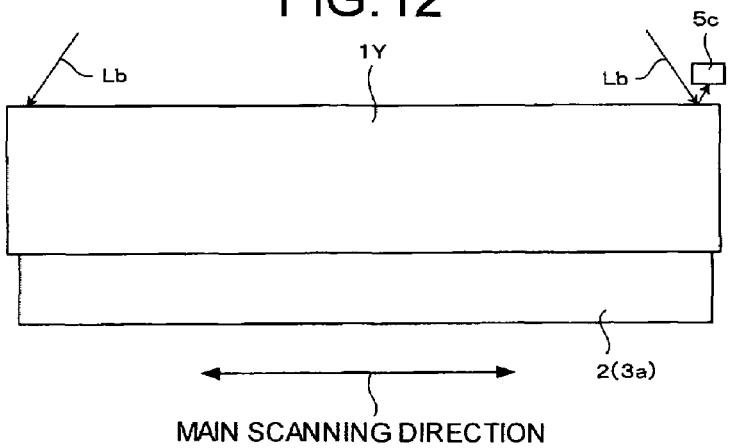
FIG. 12 illustrates a configuration where a sensor is arranged opposite to the photosensitive drum.

Another embodiment of the configuration of a multi-color image forming apparatus is shown in FIG. 12. FIG. 12 corresponds to a view of the apparatus shown in FIG. 1, as seen from the sub-scanning direction. A basic configuration of this embodiment is the same as that shown in FIGS. 1 and 2, but the apparatus of this embodiment has an additional sensor 5*c*, as shown in FIG. 12.

The sensor 5*c* is disposed at a position near the photosensitive drum 1Y, on which an incident writing light beam Lb on the photosensitive drum 1Y reflected thereby strikes. Though not shown, sensors corresponding to the sensor 5*c* are disposed regarding the other photosensitive drums 1M, 1C, and 1K.

The sensor 5*c* is constituted of a CCD line sensor, and a line thereof is directed in parallel to the main scanning direction as in the first embodiment. Data about positional deviations in the main scanning direction sampled using the sensor 5*c* is shown in FIG. 13.

Figure 13:
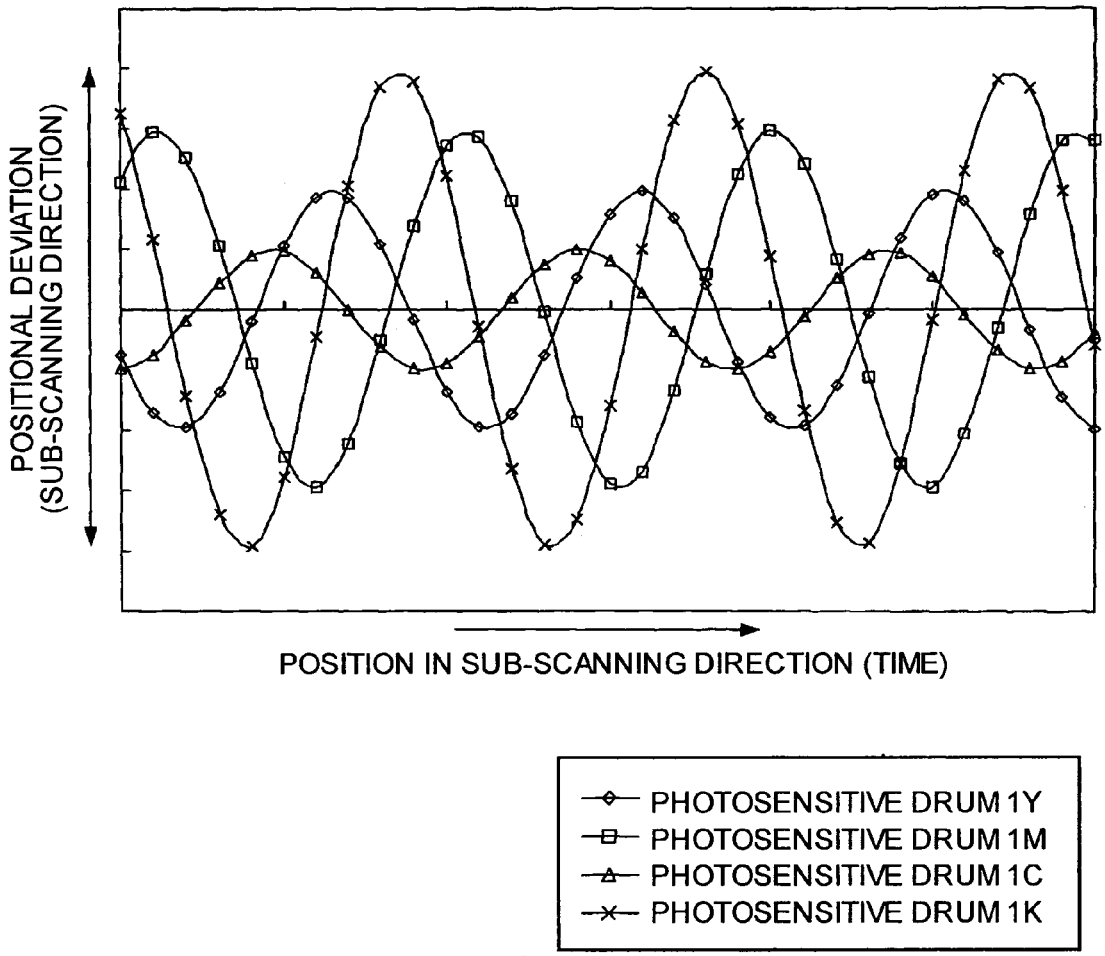
FIG. 13 is a graph of positional deviations in a sub-scanning direction due to eccentricities of four photosensitive drums detected by the sensors that are disposed opposite to the respective photosensitive drums.

As understood from the data shown in FIG. 13, positional deviation data with approximately the same phase and amplitude as those in FIG. 11 is obtained. A waveform shown in FIG. 13 is a sine wave having a more distinct shape than that in FIG. 11. A processing for changing the phase of the photosensitive drum based on this data is performed in the following manner.

In the data shown in FIG. 13, the phase of the drive pulse of the drive pulse motor for the photosensitive drum is shifted such that a value obtained by converting a time between waveform peaks of adjacent photosensitive drums, for example, the waveform peak of the photosensitive drum 1Y to a waveform peak of the photosensitive drum 1M to a distance is coincident with a distance from a transfer position of the photosensitive drum 1Y on the belt 2 to a transfer position of the photosensitive drum 1M on the belt 2 in the multi-color image forming apparatus. The rotational phase of the photosensitive drum is controlled in this manner. Thereby, the same position on the moving belt 2 is coincident with the eccentricity peak position on each photosensitive drum, so that the positional deviation in the sub-scanning direction due to the eccentricity of the photosensitive drum is eliminated.

The following explanation is directed to a specific embodiment of a multi-color image forming apparatus which is constituted so as to scan light beams on respective photosensitive drums with a face to be scanned to form electrostatic latent images thereon, visualize these electrostatic latent images using toners corresponding to color image information of the respective light beams, and transfer these visualized images on a sheet-like medium to finally obtain an image.

The following embodiment is of a multi-color image forming apparatus of a type where images formed on a plurality of photosensitive drums are transferred on an intermediate transfer belt in a superimposing manner and superimposed images on the belt are transferred on a sheet-like medium. The belt 2 explained with reference to FIGS. 1 and 2 corresponds to the intermediate transfer belt in this embodiment.

Figure 14:
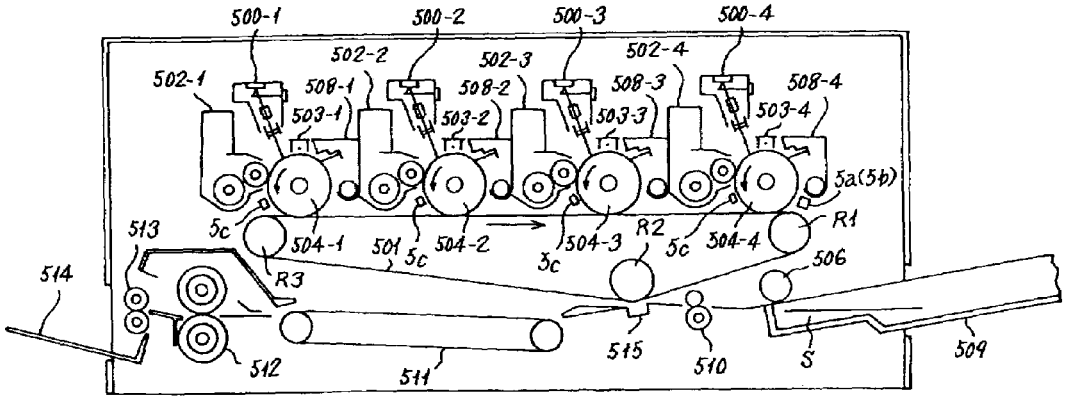
FIG. 14 is a front view of a configuration of a multi-color image forming apparatus images are transferred onto an intermediate transfer belt and then to a sheet-like medium.

In FIG. 14, light scanning units are constituted for image formations of yellow, magenta, cyan, and black, and photosensitive drums 504-1, 504-2, 504-3, and 504-4 correspond to the light scanning units denoted by reference numerals 500-1, 500-2, 500-3, and 500-4, respectively.

One color image is formed on each of the photosensitive drums 504-1, 504-2, 504-3, and 504-4 by corresponding light scanning units 500-1, 500-2, 500-3, and 500-4. A transfer belt 501 is disposed below the respective photosensitive drums 504-1, 504-2, 504-3, and 504-4 so as to come in contact with these photosensitive drums commonly.

In the embodiment shown in FIG. 14, the respective light scanning units 500-1, 500-2, 500-3, and 500-4 are arranged such that light beams emitted from these units are directed downward.

The transfer belt 501 is supported by one drive roller R1 and two supporting rollers R2 and R3. The respective photosensitive drums 504-1, 504-2, 504-3, and 504-4 are arranged at equal intervals along a moving direction of the transfer belt 501 indicated by arrows.

Chargers 503-1, 503-2, 503-3, and 503-4, developing devices 502-1, 502-2, 502-3, and 502-4 that perform development with toners corresponding to respective colors of yellow, magenta, cyan, and black, and cleaning devices 508-1, 508-2, 508-3, and 508-4 that scrape off, by blades, residual toners after images have been transferred to store them are arranged about the respective photosensitive drums 504-1, 504-2, 504-3, and 504-4 in the order to these photosensitive drums.

A scanning laser beam from the light scanning unit is irradiated on each of the photosensitive drums 504-1, 504-2, 504-3, and 504-4 at a portion thereof between the charger and the developing device so that an electrostatic latent image corresponding to image information of the light scanning unit responsible for a color is formed.

In this embodiment, patterns for positional deviation detection such as the patterns for positional deviation detection 4*a* and 4*b* explained with reference to FIG. 2 and the like are produced on an upper face of the transfer belt 501 as in the embodiment shown in FIGS. 1 and 2, and the patterns for positional deviation detection are detected by the sensors 5*a* and 5*b* disposed so as to be opposed to the transfer belt 501 or the like, so that an eccentricity phase of each photosensitive drum is calculated and a rotational phase of the photosensitive drum is controlled based on the calculated eccentricity phase.

Alternatively, the sensor 5*c* is directly disposed so as to be opposed to each photosensitive drum as in the embodiment shown in FIG. 12, and a reflected beam of a writing light beam Lb from the photosensitive drum is directly received and detected by the sensor 5*c* to obtain detection data such as shown in FIG. 13, so that a processing for changing a phase of the photosensitive drum is performed from the data.

Electrostatic latent images formed on the respective photosensitive drums 504-1, 504-2, 504-3, and 504-4 are visualized by toner developer in the developing devices 502-1, 502-2, 502-3, and 502-4 positioned downstream of rotational directions of the respective photosensitive drums, and the visualized images are sequentially transferred on the same or one image region on the transfer belt 501 from the photosensitive drums 504-1, 504-2, 504-3, and 504-4, so that an image formed from superimposed color toners is formed.

The image formed from superimposed color toners is transferred on a sheet-like medium S fed from a paper feeding tray 509 by a paper feeding roll 506 and timing-adjusted at a portion of a registration roller 510 at a secondary transfer portion where an idle roller R2 and a transfer device 515 are disposed so as to be opposed to each other via the transfer belt. The sheet-like medium S with the transferred image is fed to a fixing device 512 by a conveying belt 511, it is fixed with the transferred image in the fixing device 512, and it is fed out from the fixing device 512 to a paper discharging tray 514 by a discharging roller pair 513.

After the toner image is transferred on the transfer belt 501, residual toners are removed from the respective photosensitive drums 504-1, 504-2, 504-3,- and 504-4 by the cleaning devices 508-1, 508-2, 508-3, and 508-4 for the next image forming.

Figure 15:
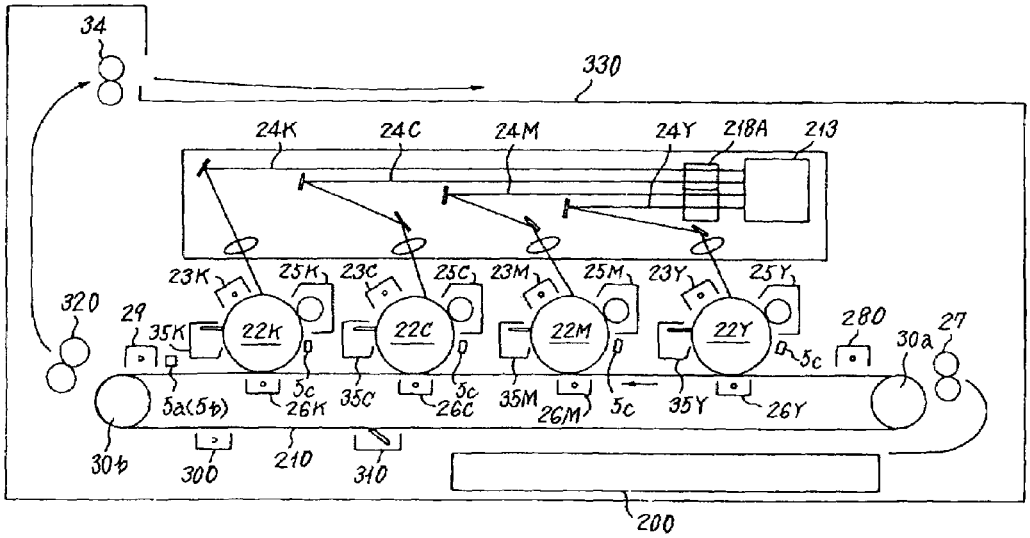
FIG. 15 is a front view of an image forming apparatus in which images are transferred directly to the sheet-like medium.

The next embodiment is of an image forming apparatus of a type where images formed on a plurality of photosensitive drums are directly transferred on a sheet-like medium in a superimposing manner, which will be explained with reference to FIG. 15. An image forming apparatus with a configuration shown in FIG. 15 is one that is constituted so as to scan a plurality of light beams including pieces of color image information emitted from the light scanning units on image carriers (photosensitive drums) with a face to be scanned to form electrostatic latent images and visualize the electrostatic latent images using color toners corresponding to the pieces of color image information of respective light beams, and directly transfer the visualized images on a sheet-like medium to obtain a color image.

The image forming apparatus in this embodiment is constituted as a tandem type full color laser printer. In FIG. 15, first, a conveying belt 210 that conveys a sheet-like medium (not shown) fed from a paper feeding cassette 200 is provided horizontally on a lower side of the apparatus. The conveying belt 210 is wound around rollers 30*a* and 30*b*. The roller 30*b* is a drive roller.

A photosensitive drum 22Y for yellow (Y), a photosensitive drum 22M for magenta (M), a photosensitive drum 22C for cyan (C), and a photosensitive drum 22K for black (K) are arranged above the. conveying belt 210 in this order from an upstream side along a paper conveying direction indicated by arrow at equal intervals. Subscripts to reference numerals are for discriminating respective colors Y, M, C, and K from one another The photosensitive drums 22Y, 22M, 22C, and 22K all have the same diameter, and process members are disposed about each of the photosensitive drums according to an electrostatic photographic process in this order. For example, regarding the photosensitive drum 22Y, a charger 23Y, a first light scanning unit 24Y, a developing device 25Y, a transfer charger 26Y, a cleaning device 35Y, and the like are arranged thereabout in this order. Regarding the other photosensitive drums 22M, 22C, and 22K, similar configuration is employed.

Regarding the photosensitive drum 22M, a charger 23M, a second light scanning unit 24M, a developing device 25M, a transfer charger 26M, a cleaning device 35M, and the like are arranged thereabout in this order. Regarding the photosensitive drum 22C, a charger 23C, a third light scanning unit 24C, a developing device 25C, a transfer charger 26C, a cleaning device 35C, and the like are arranged thereabout in this order.

Regarding the photosensitive drum 22K, a charger 23K, a fourth light scanning unit 24K, a developing device 25K, a transfer charger 26K, a cleaning device 35K, and the like are arranged thereabout in this order.

In the embodiment, peripheral faces of the photosensitive drums 22Y, 22M, 22C, and 22K are utilized as faces to be scanned, each being set to a corresponding color, and the first light scanning unit 24Y, the second light scanning unit 24M, the third light scanning unit 24C, and the fourth light scanning unit 24K are provided to these photosensitive drums in a relationship of 1: 1. Note that a polygon mirror 213 and a scanning lens (an fθ lens) 218A are used commonly by the first light scanning unit 24Y, the second light scanning unit 24M, the third light scanning unit 24C, and the fourth light scanning unit 24K.

Around the conveying belt 210, a registration roller 27, and a belt charger 280 are provided on an upstream side of the photosensitive drum 22Y and a belt separating charger 29, a neutralization charger 300, a cleaning device 310, and the like are provided on a downstream side of the photosensitive drum 22K in this order. A fixing device 320 is provided on a downstream side of the belt separating charger 29 in the conveying direction, and it is connected to a paper discharging tray 330 through a paper discharging roller pair 34.

For example, when the image forming apparatus is in a full color mode (a multi-color mode), electrostatic latent images are formed on the respective photosensitive drums 22Y, 22M, 22C, and 22K by light scannings of light beams performed by the first light scanning unit 24Y, the second light scanning unit 24M, the third light scanning unit 24C, and the fourth light scanning unit 24K based on image signals for respective colors of yellow, magenta, cyan, and black.

The electrostatic latent images are developed using respective corresponding color toners to be visualized to toner images, the toner images are sequentially transferred in a superimposing manner on a sheet-like medium electrostatically attracted on the conveying belt 210 to be conveyed and are fixed on the sheet-like medium as a full color image, and the sheet-like medium is then discharged to the paper discharging tray 330.

In this embodiment, also, patterns for positional deviation detection such as the patterns for positional deviation detection 4*a* and 4*b* explained with reference to FIG. 2 and the like are produced on an upper face of the conveying belt 210 as in the embodiment shown in FIGS. 1 and 2, and the patterns for positional deviation detection are detected by the sensors 5*a* and 5*b* disposed so as to be opposed to the conveying belt 210 or the like, so that an eccentricity phase of each photosensitive drum is calculated and a rotational phase of the photosensitive drum is controlled based on the calculated eccentricity phase.

Alternatively, the sensor 5*c* is directly disposed so as to be opposed to each photosensitive drum as in the embodiment shown in FIG. 12, a reflected beam of a writing light beam Lb from the photosensitive drum is directly received and detected by the sensor 5*c* to obtain detection data such as shown in FIG. 13, so that a processing for changing a phase of the photosensitive drum is performed according to the data.

According to one aspect of the present invention, accurate information about eccentricity can be obtained by a simple calculation method to reduce positional deviation of the drum cycle in the main scanning direction.

Moreover, one unit is used for both, detecting a positional deviation in a main scanning direction, and correcting the "swinging", which allows a simple configuration.

Furthermore, detection of the positional deviation in the main scanning direction is possible, without interference of "swinging".

Moreover, the effect due to "swinging" can be obtained easily.

Furthermore, precise eccentricity data can be obtained.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of photosensitive drums, on which images are formed and from which the images formed are transferred in a superimposing manner to produce a multi-color image;

deviation detecting means for detecting a positional deviation in a main scanning direction, which is generated while transferring the images formed, by calculating an eccentricity phase of each of the photosensitive drums based on the positional deviation measured in the main scanning direction, and a rotational phase of the photosensitive drums is controlled based on the eccentricity phase calculated.

2. The image forming apparatus according to claim 1, wherein the photosensitive drums are arranged opposite to a belt wound around a plurality of rollers, along a rotational direction of the belt, and the deviation detecting means detects a position of a pattern meant for detecting the positional deviation, after the image formed on the photosensitive drum is transferred onto the belt.

3. The image forming apparatus according to claim 2, wherein one of the rollers is a transfer belt drive roller, and a circumference of the transfer belt drive roller is any one of N times a circumference of the photosensitive drum, and 1/N times the circumference of the photosensitive drum, where N is an integer and N is at least equal to 2.

4. The image forming apparatus according to claim 2, wherein the pattern for positional deviation detection is provided at each end portion of the belt in a widthwise direction thereof, and the positional deviation in the main scanning direction caused by eccentricity of the photosensitive drum is discriminated from "swinging" in the main scanning direction generated on the belt by the transfer belt drive roller, by comparing the positional deviation in the main scanning direction detected from both the patterns.

5. The image forming apparatus according to claim 2, wherein the belt corresponds to an intermediate transfer belt in a multi-color image forming apparatus, wherein images formed on a plurality of photosensitive drums are superimposed, transferred onto the belt, and then the superimposed images on the belt are transferred onto a sheet-like medium, and the belt corresponds to a conveying belt that conveys the sheet-like medium in an image forming apparatus, wherein images formed on a plurality of photosensitive drums are superimposed, and transferred directly onto the sheet-like medium.

6. The image forming apparatus according to claim 1, wherein the deviation detecting unit is provided with a sensor at a position opposite to a surface of the photosensitive drum, to detect a reflection position of an irradiated writing light beam.

7. An image forming apparatus comprising:

a plurality of photosensitive drums having a scanning surface on which light beams are scanned to produce electrostatic latent images that are visualized with toners corresponding to color image information of respective the light beams, to obtain visualized images that are finally transferred on a sheet-like medium to obtain an image; and a deviation detecting means for detecting a positional deviation in a main scanning direction, which is generated while transferring the visualized images, wherein a rotational phase of the photosensitive drums is controlled based on the positional deviation detected.

8. An image forming method comprising:

detecting a positional deviation in a main scanning direction, which is generated while transferring images formed on photosensitive drums onto a writing medium;

calculating an eccentricity phase of each of the photosensitive drums based on the positional deviation detected; and controlling a rotational phase of the photosensitive drums based on the eccentricity phase calculated.

* * * * *